US009670426B2

(12) United States Patent
Roney

(10) Patent No.: US 9,670,426 B2
(45) Date of Patent: Jun. 6, 2017

(54) METHODS FOR HYDROCRACKING HEAVY AND LIGHT HYDROCARBONS

(71) Applicant: UOP LLC, Des Plaines, IL (US)

(72) Inventor: Scott M. Roney, Wheaton, IL (US)

(73) Assignee: UOP LLC, Des Plaines, IL (US)

( * ) Notice: Subject to any disclaimer, the term of this patent is extended or adjusted under 35 U.S.C. 154(b) by 372 days.

(21) Appl. No.: 14/302,317

(22) Filed: Jun. 11, 2014

(65) Prior Publication Data

US 2015/0361358 A1 Dec. 17, 2015

(51) Int. Cl.

| | |
|---|---|
| ***C10G 65/10*** | (2006.01) |
| ***C10G 65/18*** | (2006.01) |
| ***C10G 65/12*** | (2006.01) |

(52) U.S. Cl.

CPC ..... *C10G 65/18* (2013.01); *C10G 65/10* (2013.01); *C10G 65/12* (2013.01); *C10G 2400/02* (2013.01); *C10G 2400/04* (2013.01); *C10G 2400/06* (2013.01); *C10G 2400/08* (2013.01)

(58) Field of Classification Search

CPC ..... C10G 2400/02; C10G 2400/04; C10G 2400/06; C10G 2400/08; C10G 65/10; C10G 65/12; C10G 65/18

See application file for complete search history.

(56) References Cited

U.S. PATENT DOCUMENTS

| | | | |
|---|---|---|---|
| 3,239,447 | A | 3/1966 | Reeg et al. |
| 3,755,137 | A | 8/1973 | Schuman |
| 5,904,835 | A | 5/1999 | Thakkar et al. |
| 6,113,775 | A | 9/2000 | Christolini et al. |
| 7,238,277 | B2 | 7/2007 | Dahlberg et al. |
| 7,531,082 | B2 | 5/2009 | Mukherjee et al. |
| 7,547,386 | B1 | 6/2009 | Thakkar et al. |
| 2010/0200459 | A1 | 8/2010 | Bhattacharya |
| 2012/0024752 | A1 | 2/2012 | Chen et al. |

OTHER PUBLICATIONS

Mukherjee, U et al., "Technology: Latest innovations in Chevron Lummus Global's hydro-processing technologies," Hydrocarbon Asia, v 14, n 2, p. 32-35, Mar./Apr. 2004; ISSN: 02171112; Publisher: AP Energy Business Publications PTE.

Khavkin V A et al., "Kinetic Study of the Conversion of Hydrocarbons in the Second Stage of Hydrocracking of Gas Oil," Khim I Tekhnol Topliv I Masel V11 N. 12 14-17 (Dec. 1966).

*Primary Examiner* — Renee Robinson
*Assistant Examiner* — Derek Mueller

(57) ABSTRACT

Methods and apparatuses for processing hydrocarbons are provided. In one embodiment, a method for processing a hydrocarbon stream including lighter hydrocarbons and heavier hydrocarbons includes hydrocracking the lighter hydrocarbons in a hydrocracking reactor. After hydrocracking the lighter hydrocarbons, the method hydrocracks the heavier hydrocarbons in the hydrocracking reactor. The method includes removing from the hydrocracking reactor a hydrocracking effluent comprising a mixture of components formed by hydrocracking the lighter hydrocarbons and hydrocracking the heavier hydrocarbons.

19 Claims, 1 Drawing Sheet

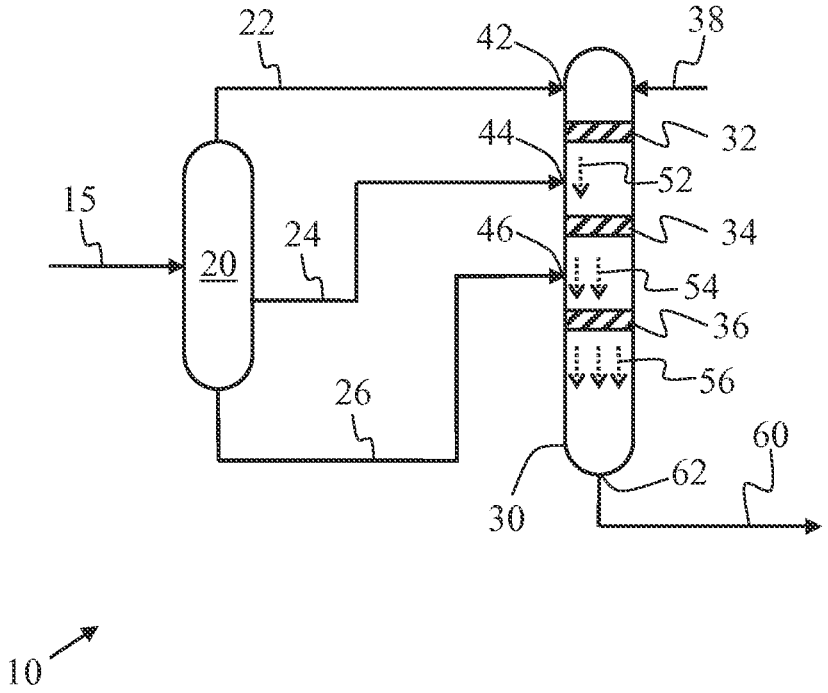
22
42
38
44
32
52
15
24
46
34
20
54
36
56
26
60
62
30
10

METHODS FOR HYDROCRACKING HEAVY AND LIGHT HYDROCARBONS

TECHNICAL FIELD

The technical field generally relates to methods and apparatuses for processing hydrocarbons, and more particularly relates to methods and apparatuses for efficiently hydrocracking both heavy and light hydrocarbons.

BACKGROUND

Petroleum refiners often produce desirable products, such as turbine fuel, diesel fuel and other products known as middle distillates, as well as lower boiling hydrocarbonaceous liquids, such as naphtha and gasoline, by hydrocracking a hydrocarbon feedstock derived from crude oil or heavy fractions thereof. Feedstocks most often subjected to hydrocracking are the gas oils and heavy gas oils recovered from crude oil by distillation. A typical heavy gas oil comprises a substantial portion of hydrocarbon components boiling above 370° C. (700° F.). A typical vacuum gas oil has a boiling point range between 315° C. (600° F.) and about 565° C. (1050° F.).

Hydrocracking is generally accomplished by contacting in a hydrocracking reaction vessel or zone the gas oil or other feedstock to be treated with a suitable hydrocracking catalyst under conditions of elevated temperature and pressure in the presence of hydrogen so as to yield a product containing a distribution of hydrocarbon products desired by the refiner. Generally, middle distillates are the most desirable products, naphtha and gasoline are less desirable, and light ends comprising hydrocarbons with 1 to 4 carbons are the least desirable. The operating conditions and the hydrocracking catalyst within the hydrocracking reactor influence the yield of the hydrocracked products.

Traditionally, the fresh feedstock for a hydrocracking process is first introduced into a denitrification and desulfurization reaction zone particularly suited for the removal of sulfur and nitrogen contaminants. Subsequently, the feedstock is introduced into a hydrocracking zone containing hydrocracking catalyst. Within the hydrocracking zone, heavier components of the hydrocarbon feedstock tend to undergo cracking before lighter components of the hydrocarbon feedstock. Specifically, cracking catalysts show at least some selectivity toward cracking heavier components, i.e., components having higher boiling temperatures, over lighter components, i.e., components having lower boiling temperatures. Thermodynamically, cracking of heavier hydrocarbon components is preferred as such cracking results in a larger increase in entropy. Conventional processes tend to have poor selectivity toward middle distillates.

Accordingly, it is desirable to provide methods and apparatuses for upgrading hydrocarbon streams with improved efficiency. In addition, it is desirable to provide methods and apparatuses that economically hydrocrack hydrocarbon streams. Furthermore, other desirable features and characteristics will become apparent from the subsequent detailed description and the appended claims, taken in conjunction with the accompanying drawings and the foregoing technical field and background.

BRIEF SUMMARY

Methods and apparatuses for hydrocracking hydrocarbons are provided. In an exemplary embodiment, a method for processing a hydrocarbon stream including lighter hydrocarbons and heavier hydrocarbons includes hydrocracking the lighter hydrocarbons in a hydrocracking reactor. After hydrocracking the lighter hydrocarbons, the method hydrocracks the heavier hydrocarbons in the hydrocracking reactor. The method includes removing from the hydrocracking reactor a hydrocracking effluent comprising a mixture of components formed by hydrocracking the lighter hydrocarbons and hydrocracking the heavier hydrocarbons.

In another embodiment, a method for processing hydrocarbons includes fractionating the hydrocarbons into a stream rich in lighter hydrocarbons and a stream rich in heavier hydrocarbons. The method includes feeding the stream rich in lighter hydrocarbons to an upstream location in a hydrocracking zone and hydrocracking the stream rich in lighter hydrocarbons to form lighter hydrocracking products. Further, the method includes feeding the stream rich in heavier hydrocarbons into the lighter hydrocracking products at a downstream location in the hydrocracking zone and hydrocracking the stream rich in heavier hydrocarbons to form heavier hydrocracking products.

In accordance with another exemplary embodiment, an apparatus for processing a hydrocarbon stream is provided. The apparatus includes a fractionation unit having an upper outlet and a lower outlet and configured to discharge a stream rich in lighter hydrocarbons from the upper outlet and a stream rich in heavier hydrocarbons from the lower outlet. The apparatus further includes a hydrocracking reactor having an upper inlet in fluid communication with the upper outlet of the fractionation unit for receiving the stream rich in lighter hydrocarbons. The hydrocracking reactor includes an upper hydrocracking zone for hydrocracking the stream rich in lighter hydrocarbons. Also, the hydrocracking reactor includes a lower inlet in fluid communication with the lower outlet of the fractionation unit for receiving the stream rich in heavier hydrocarbons. Further, the hydrocracking reactor includes a lower hydrocracking zone for hydrocracking the stream rich in heavier hydrocarbons.

BRIEF DESCRIPTION OF THE DRAWINGS

Embodiments of methods and apparatuses for hydrocracking hydrocarbons will hereinafter be described in conjunction with the following drawing figure wherein:

FIG. 1 is a schematic diagram of an apparatus for hydrocracking hydrocarbons in accordance with an embodiment.

DETAILED DESCRIPTION

The following detailed description is merely exemplary in nature and is not intended to limit the methods and apparatuses for hydrocracking hydrocarbons claimed herein. Furthermore, there is no intention to be bound by any theory presented in the preceding background or the following detailed description.

As described herein, methods and apparatuses provide increased efficiency for hydrocracking conversion of hydrocarbon streams by hydrocracking lighter components before hydrocracking heavier components. As used herein, "heavy" and "light" components refer to the relative boiling temperature of components. Thus, a "heavy" component has a higher boiling temperature than a "light" component. Accordingly, a "heaviest" component has a higher boiling temperature than a "heavier" component that, in turn, has a higher boiling temperature than a "lighter" component. The hydrocracking process may be a once-through process, i.e., using a single pass of a hydrocarbon stream through a hydrocracking zone. The exemplary methods and apparatuses described herein fractionate the hydrocarbon feed stream into a heavy and light fraction (or into more than two fractions such as heaviest, heavier, and lighter fractions). Each fraction is fed to the hydrocracking zone, with the lightest fraction fed to the most upstream catalyst bed, the heaviest fraction fed to the most downstream catalyst bed, and middle fractions fed to respective middle catalyst beds. As a result, hydrocracking reactions are performed on lighter fractions before heavier fractions. In this manner, the methods and apparatuses prevent the concentration of unconverted lighter components of the hydrocarbon feedstock from decreasing in proportion to the concentration of cracked products of the heavier components of the hydrocarbon feedstock. Thus, catalyst selectivity is not decreased at high conversion conditions.

The methods and apparatuses described herein differ from conventional processing, in which a hydrocarbon stream including heavy and light components is fed into a hydrocracking zone. Conventionally, the heavier components are selectively hydrocracked over lighter components. As the heavier components are cracked, the concentration of unconverted lighter components of the hydrocarbon feedstock decreases in proportion to the concentration of cracked products of the heavier components of the hydrocarbon feedstock. As that concentration decreases, the catalyst in the hydrocracking zone becomes more likely to convert, or re-crack, cracked products rather than cracking unconverted lighter components. This results in a decrease in selectivity to middle distillates when operating at high conversion rate conditions with a simultaneous decrease in incremental conversion, i.e., increased conversion of unconverted components per degree of increased temperature or per unit of increased catalyst volume.

As described herein, the exemplary methods and apparatuses efficiently process hydrocarbon streams by hydrocracking lighter hydrocarbon components separately from heavier hydrocarbon components. In this manner, selectivity to middle distillates in increased over conventional processing. In an exemplary embodiment, a hydrocarbon feed stream is fractionated into at least two streams, such as a stream rich in heavy components having boiling temperatures in a first temperature range and a stream rich in light components having boiling temperatures in a second temperature range less than the first temperature range. As referred to herein, "rich in" the component referred to means that the referenced stream has a higher content of the subject component than any other stream that is produced through fractionation and/or subject to hydrocracking. In embodiments, the streams that are "rich in" the subject component have a content of the component of at least 50 weight % (wt %), based on the total weight of the subject component. In exemplary embodiments, a stream "rich in" a subject component has a content of the component of at least 75 wt %, such as at least 90 wt %. In certain embodiments, a stream "rich in" a subject component has a content of the component of at least 95 wt % or at least 98 wt %. The stream rich in light components is fed to a hydrocracking zone at an upstream location and undergoes hydrocracking to form hydrocracking products. Then, the stream rich in heavy hydrocarbon components is added to the hydrocracking zone at a downstream location. With the reduced presence of heavier components and the hydrocracked products of heavy components in the upstream portion of the hydrocracking zone, the light components are more efficiently hydrocracked. Further, the introduction of the stream rich in heavy components at the downstream location serves to quench the hydrocracking products from the light hydrocarbon components. As a result, inter-bed hydrogen quenching may be unnecessary in the exemplary methods and apparatuses.

FIG. 1 is a schematic of an apparatus 10 for processing a hydrocarbon feed stream 15 in accordance with an exemplary embodiment. An exemplary hydrocarbon feed stream 15 may be formed as a bottom stream from a vacuum fractionation zone (not shown). As used herein, "bottom stream" refers to a stream withdrawn at or near a bottom of a column, such as a distillation column The exemplary feed stream may also include heavy hydrocarbons, such as light cycle oil and vacuum gas oil. As used herein, "light cycle oil" refers to a hydrocarbon material boiling in a range of from about 204° C. to about 343° C. (about 400° F. to about 650° F.) and can include one or more $C_{13}$-$C_{18}$ hydrocarbons, and "vacuum gas oil" refers to a hydrocarbon material boiling in the range of from about 343° C. to about 524° C. (about 650° F. to about 975° F.) and can include one or more $C_{22}$-$C_{45}$ hydrocarbons. Exemplary hydrocarbon feed streams 15 suitable for processing by the apparatus 10 are vacuum gas oils having boiling points in the range of about 370° C. to about 590° C. (about 700° F. to about 1100° F.), for example from about 343° C. to about 565° C. (about 650° F. to about 1050° F.). In addition to, or other than, vacuum gas oil, particular fresh feed components may include a wide variety of straight run and converted hydrocarbon fractions obtained in refinery operations (i.e., derived from crude oil), such as atmospheric gas oils, vacuum and deasphalted vacuum resids (e.g., boiling above 565° C. (1050° F.)), atmospheric resids (e.g., boiling above about 343° C. (650° F.)), coker distillates, straight run distillates, whole or topped petroleum crude oils including heavy crude oils, pyrolysis-derived oils, high boiling synthetic oils, cycle oils and catalytic cracker (e.g., fluid catalytic cracking or FCC) distillates. Fresh feed components of the heavy hydrocarbon feed stream 15 may also include mineral oils and synthetic oils (e.g., tars, bitumen, coal oils, shale oil, tar sand products, etc.) and fractions thereof.

As shown, the hydrocarbon feed stream 15 is fed to a fractionation unit 20. The fractionation unit 20 separates the hydrocarbon feed stream 15 into light fraction 22 rich in hydrocarbon components having boiling points in a first range, a middle fraction 24 rich in hydrocarbon components having boiling points in a second range higher than the first range, and a heavy fraction 26 rich in hydrocarbon components having boiling points in a third range higher than the second range. For example, the light fraction may be rich in hydrocarbons having boiling points of less than about 425° C. (less than about 800° F.), the middle fraction may be rich in hydrocarbons having boiling points of from about 425° C. to about 480° C. (about 800° F. to about 900° F.), and the heavy fraction may be rich in hydrocarbons having boiling points of greater than about 480° C. (900° F.).

While FIG. 1 illustrates fractionation of the hydrocarbon feed stream into three fractions, it is contemplated that in other embodiments, the hydrocarbon feed stream 15 can be fractionated into two fractions, or four or more fractions. For example, the fractionation unit 20 may fractionate the hydrocarbon feed stream 15 into two fractions including a light fraction 22 rich in hydrocarbons having boiling points of from about 370° C. to about 450° C. (about 700° F. to about 850° F.) and into a heavy fraction 26 rich in hydrocarbons having boiling points of from about 450° C. to about 590° C. (about 850° F. to about 1100° F.).

As shown in FIG. 1, each fraction 22, 24 and 26 is fed to a hydrocracking zone 30. As used herein, the term "zone" can refer to an area including one or more equipment items and/or one or more sub-zones. Equipment items can include one or more reactors or reactor vessels, heaters, exchangers, pipes, pumps, compressors, and controllers. Additionally, an equipment item, such as a reactor, dryer, or vessel, can further include one or more zones or sub-zones. In an exemplary embodiment, the hydrocracking zone 30 encompasses a single hydrocracking reactor. As shown, the hydrocracking zone 30 includes catalyst beds 32, 34, and 36 arranged in series. Also, the hydrocracking zone 30 receives a hydrogen stream 38. The hydrogen stream 38 may be introduced through the fraction 22 or directly into the hydrocracking zone 30 as shown.

The light fraction 22 is introduced to the hydrocracking zone 30 at a location 42 above and upstream of the catalyst bed 32. As a result, it undergoes hydrocracking over the catalyst bed 32 in the hydrogen atmosphere of the hydrocracking zone 30 and forms hydrocracking products 52 that move in a downward direction through the catalyst bed 32. In an exemplary embodiment, at least about 50 weight percent (wt %) of the light fraction 22 is converted to hydrocracking products 52, such as at least about 60 wt % of the light fraction 22, or for example, at least about 70 wt % of the light fraction 22. The hydrocracking products 52 are lighter than the light fraction 22 and typically have boiling points of from about 150° C. to about 370° C. (about 300° F. to about 700° F.).

As shown, the middle fraction 24 is introduced to the hydrocracking zone 30 at a location 44 below and downstream of the catalyst bed 32 and above and upstream of the catalyst bed 34. The middle fraction 24 enters the hydrocracking zone 30 and is fed into the hydrocracking products 52 formed at the catalyst bed 32. The middle fraction 24 undergoes hydrocracking over the catalyst bed 34 in the hydrogen atmosphere and forms hydrocracking products 54 that, with the hydrocracking products 52, move in a downward direction through the catalyst bed 34. The catalyst bed 34 is selective toward the heavier components of the middle fraction 24 over the hydrocracking products 52 from the catalyst bed 32, as the heavier components of the middle fraction 24 are significantly heavier than the hydrocracking products 52. In an exemplary embodiment, at least about 90 wt % of the middle fraction 24 is converted to hydrocracking products 54, such as at least about 95 wt % of the middle fraction 24, or for example, at least about 99 wt % of the middle fraction 24. The hydrocracking products 54 are lighter than the middle fraction 24 and typically have boiling points of from about 150° C. to about 370° C. (about 300° F. to about 700° F.).

As shown, the heavy fraction 26 is introduced to the hydrocracking zone 30 at a location 46 below and downstream of the catalyst bed 34 and above and upstream of the catalyst bed 36. The heavy fraction 26 enters the hydrocracking zone 30 and is combined with the hydrocracking products 52 and 54 formed at the catalyst beds 32 and 34. The heavy fraction 26 undergoes hydrocracking over the catalyst bed 36 in the hydrogen atmosphere and forms hydrocracking products 56 that, with the hydrocracking products 52 and 54, move in a downward direction through the catalyst bed 36. The catalyst bed 36 is selective toward the heavier components of the heavy fraction 26 over the hydrocracking products from the catalyst beds 32 and 34, as the heavier components of the heavy fraction 26 are significantly heavier than the hydrocracking products 52 and 54. In an exemplary embodiment, at least about 50 wt % of the heavy fraction 26 is converted to hydrocracking products, such as at least about 60 wt % of the heavy fraction 26, or for example, at least about 70 wt % of the heavy fraction 26. The hydrocracking products 56 are lighter than the heavy fraction 26 and typically have boiling points of from about 150° C. to about 370° C. (about 300° F. to about 700° F.).

In an exemplary embodiment, the hydrocracking reaction conditions in the hydrocracking zone 30 include a temperature from about 205° C. to about 480° C. (about 400° F. to about 900° F.) and a pressure from about 3.5 megapascals (MPa) to about 20.8 MPa (500 pounds per square inch gauge (psig) to about 3000 psig). In addition, hydrocracking conditions may include a liquid hourly space velocity from about 0.1 to about 30 $hr^{-1}$.

Any conventional hydrocracking catalyst may be used in the hydrocracking catalyst beds 32, 34 and 36. Examples of suitable catalysts for use in the hydrocracking catalyst beds 32, 34 and 36 include, but are not limited to, those comprising a metal selected from the group consisting of iron, nickel, cobalt, tungsten, molybdenum, vanadium, ruthenium, and mixtures thereof, deposited on a support containing a zeolite or another component exhibiting Bronsted acidity. Representative zeolites for hydrocracking catalyst supports include beta zeolite, Y zeolite and MFI zeolite.

An exemplary hydrocracking catalyst has a size and shape that is similar to those of conventional commercial catalysts. An exemplary hydrocracking catalyst is manufactured in the form of a cylindrical extrudate having a diameter of from about 0.8 millimeters (mm) to about 3.2 mm (1/32 inches to about 1/8 inches). The catalyst can however be made in any other desired form such as a sphere or pellet. The extrudate may be in forms other than a cylinder such as the form of a trilobe or other shape that has advantages in terms or reduced diffusional distance or pressure drop.

An exemplary hydrocracking catalyst may contain a number of non-zeolitic materials that can beneficially affect particle strength, cost, porosity, and performance. The other catalyst components, therefore, make positive contributions to the overall catalyst even if not necessary as active cracking components. These other components are part of the catalyst support. Some traditional components of the support such as silica-alumina normally make some contribution to the cracking capability of the catalyst. Other inorganic refractory materials that may be used as a support in addition to silica-alumina and alumina include for example silica, zirconia, titania, boria, and zirconia-alumina. These aforementioned support materials may be used alone or in any combination.

An exemplary hydrocracking catalyst may contain a metallic hydrogenation component. The hydrogenation component may be provided as one or more base metals uniformly distributed in the catalyst particle. Noble metals such as platinum and palladium could be applied or a combination of two base metals may be used. Specifically, either nickel or cobalt may be paired with tungsten or molybdenum, respectively.

An exemplary hydrocracking catalyst can be formulated using industry standard techniques. This can be summarized as admixing a zeolite with the other inorganic oxide components and a liquid such as water or a mild acid to form an extrudable dough followed by extrusion through a multihole die plate. The extrudate is collected and may be calcined at high temperature to harden the extrudate. The extruded particles are then screened for size and the hydrogenation components are added as by dip impregnation or the well known incipient wetness technique. If the catalyst contains two metals in the hydrogenation component these may be added sequentially or simultaneously. The catalyst particles may be calcined between metal addition steps and again after the metals are added. The finished catalyst may have a surface area between about 200 and 600 $m^2/g$ and an average bulk density (ABD) from about 0.8 to about 1.0 g/cc.

As shown, the hydrocracking products 52, 54 and 56 exit the hydrocracking zone 30 as an effluent stream 60 from outlet 62. The effluent stream 60 may comprise at least about 80 wt % of hydrocarbons having boiling points of less than about 382° C. (720° F.). Further processing of the effluent stream 60 may include fractionation, denitrification, desulfurization, stripping and washing to form product streams such as naphtha, kerosene, and/or diesel streams and to recover vacuum gas oil.

Any of the above components of the hydrocarbon feed stream 15 may be hydrotreated prior to being introduced into the hydrocracking zone 30, to remove, for example, sulfur and/or nitrogen compounds such that the fractions 22, 24 and 26 will have total sulfur and nitrogen levels below, for example, 500 ppm by weight and 100 ppm by weight, respectively. Hydrotreating may be performed in a separate hydrotreating reactor or in the same reactor as used for hydrocracking by incorporating, for example, a bed of hydrotreating catalyst upstream of each bed of hydrocracking catalyst. If hydrotreating is performed in a separate hydrotreating reactor, there may be additional zones upstream of zone 20 in which various separation operations are performed, including but not limited to vapor-liquid disengaging, steam stripping, flash separation by reduction of pressure, and/or distillation. The lower-boiling material removed in these operations would not be fed into zone 20.

The exemplary hydrocracking zone 30 includes a total catalyst volume. Accordingly, each catalyst bed in the hydrocracking zone 30 includes a fraction of the total catalyst volume. Further, the hydrocarbon feed stream 15 has a total hydrocarbon volume and each fraction 22, 24 and 26 of hydrocarbons includes a feed volume fraction of the total hydrocarbon volume. In an exemplary embodiment, the fraction of the total catalyst volume in the upper bed 32 does not exceed the feed volume fraction of the fraction 22 fed to the upper bed 32. Likewise, the fraction of the total catalyst volume in any second, non-bottom bed 34 does not exceed the feed volume fraction of the fraction 24 fed to the second, non-bottom bed 34. However, the fraction of the total catalyst volume in the bottom bed 36 does exceed the feed volume fraction of the fraction 26 fed to the bottom bed 36. For example, in a hydrocracking zone 30 having two beds 32 and 36, the fraction 22 may be formed from two-thirds of the hydrocarbon feed stream 15 and the fraction 26 may be formed from one-third of the hydrocarbon feed stream 15. In such an embodiment, no more than two-thirds of the total catalyst volume in the hydrocracking zone 30 will be in the upper catalyst bed 32 and at least one-third of the total catalyst volume in the hydrocracking zone 30 will be in the lower catalyst bed 36.

The methods and apparatuses described herein provide increased efficiency for hydrocracking conversion of hydrocarbon streams and may be implemented in a once-through process, i.e., in embodiments, the hydrocarbon streams pass only once through the hydrocracking zone. The methods and apparatuses fractionate the hydrocarbon feed stream into a heavy and light fraction (or into more than two fractions such as heaviest, heavier, and lighter fractions). Each fraction is fed to the hydrocracking zone, with the lightest fraction fed to the most upstream catalyst bed, the heaviest fraction fed to the most downstream catalyst bed, and middle fractions fed to respective middle catalyst beds. As a result, hydrocracking reactions are performed on lighter fractions before heavier fractions. In this manner, the methods and apparatuses prevent the concentration of unconverted lighter components of the hydrocarbon feedstock from decreasing in proportion to the concentration of cracked products of the heavier components of the hydrocarbon feedstock. Thus, catalyst selectivity to middle distillates is not decreased at high conversion conditions.

Further, the addition of heavier fractions at inter-bed locations provides for quenching of the hydrocracking products formed at upstream catalyst beds. As a result, hydrogen need not be added at inter-bed location as in conventional apparatuses.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the claimed subject matter in any way. Rather, the foregoing detailed description will provide those skilled in the art with a convenient road map for implementing an exemplary embodiment or embodiments. It being understood that various changes may be made in the function and arrangement of elements described in an exemplary embodiment without departing from the scope set forth in the appended claims.

What is claimed is:

1. A method for processing a hydrocarbon stream including lighter hydrocarbons and heavier hydrocarbons, the method comprising:

hydrocracking the lighter hydrocarbons in a hydrocracking reactor;

after hydrocracking the lighter hydrocarbons, hydrocracking the heavier hydrocarbons in the hydrocracking reactor; and removing from the hydrocracking reactor a hydrocracking effluent comprising a mixture of components formed by hydrocracking the lighter hydrocarbons and hydrocracking the heavier hydrocarbons.

2. The method of claim 1 wherein:

hydrocracking the lighter hydrocarbons in the hydrocracking reactor comprises hydrocracking hydrocarbons having boiling points below about 480° C. (about 900° F.); and hydrocracking the heavier hydrocarbons in the hydrocracking reactor comprises hydrocracking hydrocarbons having boiling points above about 425° C. (about 800° F.).

3. The method of claim 1 wherein hydrocracking the lighter hydrocarbons comprises hydrocracking over 50 wt % of the lighter hydrocarbons, based on the total weight of the lighter hydrocarbons, before hydrocracking the heavier hydrocarbons.

4. The method of claim 1 wherein hydrocracking the lighter hydrocarbons comprises hydrocracking over 60 wt % of the lighter hydrocarbons, based on the total weight of the lighter hydrocarbons, before hydrocracking the heavier hydrocarbons.

5. The method of claim 1 wherein hydrocracking the lighter hydrocarbons comprises hydrocracking over 70 wt % of the lighter hydrocarbons, based on the total weight of the lighter hydrocarbons, before hydrocracking the heavier hydrocarbons.

6. The method of claim 1 wherein removing from the hydrocracking reactor the hydrocracking effluent comprises removing the hydrocracking effluent comprising at least about 80 wt % of hydrocarbons having boiling points of less than about 382° C. (720° F.).

7. The method of claim 1 wherein the hydrocarbon stream further includes heaviest hydrocarbons having a higher boiling temperature than the heavier hydrocarbons, and wherein the method further comprises:

after hydrocracking the heavier hydrocarbons, hydrocracking the heaviest hydrocarbons in the hydrocracking reactor, wherein removing from the hydrocracking reactor a hydrocracking effluent comprises removing from the hydrocracking reactor a hydrocracking effluent formed by hydrocracking the lighter hydrocarbons, hydrocracking the heavier hydrocarbons, and hydrocracking the heaviest hydrocarbons.

8. A method for processing hydrocarbons, the method comprising the steps of:

fractionating the hydrocarbons into a stream rich in lighter hydrocarbons and a stream rich in heavier hydrocarbons;

feeding the stream rich in lighter hydrocarbons to an upstream location in a hydrocracking zone;

hydrocracking the stream rich in lighter hydrocarbons to form lighter hydrocracking products;

feeding the stream rich in heavier hydrocarbons into the lighter hydrocracking products at a downstream location in the hydrocracking zone; and hydrocracking the stream rich in heavier hydrocarbons to form heavier hydrocracking products.

9. The method of claim 8 wherein fractionating the hydrocarbons comprises fractionating the hydrocarbons into the stream rich in lighter hydrocarbons having an initial boiling point of about 370° C. (about 700° F.) and into the stream rich in heavier hydrocarbons having a final boiling point of from about 510° C. to about 590° C. (about 950° F. to about 1100° F.).

10. The method of claim 8 further comprising feeding hydrogen to the upstream location in the hydrocracking zone, wherein the stream rich in heavier hydrocarbons quenches the lighter hydrocracking products at the downstream location in the hydrocracking zone.

11. The method of claim 8 wherein:

feeding the stream rich in lighter hydrocarbons to an upstream location in a hydrocracking zone comprises feeding the stream rich in lighter hydrocarbons to an upper bed in a hydrocracking reactor; and feeding the stream rich in heavier hydrocarbons into the lighter hydrocracking products at the downstream location in the hydrocracking zone comprises feeding the stream rich in heavier hydrocarbons to a lower bed in the hydrocracking reactor, wherein the fraction of the total catalyst volume in the upper bed does not exceed the volume fraction of the total hydrocarbons fed to the upper bed.

12. The method of claim 8 wherein fractionating the hydrocarbons comprises fractionating the hydrocarbons into the stream rich in lighter hydrocarbons, the stream rich in heavier hydrocarbons, and a stream rich in heaviest hydrocarbons, the method further comprising:

feeding the stream rich in heaviest hydrocarbons into the lighter hydrocracking products and the heavier hydrocracking products at a farther downstream location in the hydrocracking zone; and hydrocracking the stream rich in heaviest hydrocarbons to form heaviest hydrocracking products.

13. The method of claim 12 wherein fractionating the hydrocarbons comprises fractionating the hydrocarbons into the stream rich in lighter hydrocarbons having boiling points of less than about 425° C. (less than about 800° F.), into the stream rich in heavier hydrocarbons having boiling points of from about 425° C. to about 480° C. (about 800° F. to about 900° F.), and into the stream rich in heaviest hydrocarbons having boiling points of greater than about 480° C. (900° F.).

14. The method of claim 12 wherein:

feeding the stream rich in lighter hydrocarbons to an upstream location in a hydrocracking zone comprises feeding the stream rich in lighter hydrocarbons to a first bed in a hydrocracking reactor;

feeding the stream rich in heavier hydrocarbons into the lighter hydrocracking products at the downstream location in the hydrocracking zone comprises feeding the stream rich in heavier hydrocarbons to a second bed below the first bed in the hydrocracking reactor; and feeding the stream rich in heaviest hydrocarbons into the lighter hydrocracking products and the heavier hydrocracking products at the farther downstream location in the hydrocracking zone comprises feeding the stream rich in heaviest hydrocarbons to a third bed below the second bed in the hydrocracking reactor; and wherein:

the fraction of the total catalyst volume in the first bed does not exceed the volume fraction of the total hydrocarbons fed to the first bed; and the fraction of the total catalyst volume in the second bed does not exceed the volume fraction of the heavier hydrocarbons fed to the second bed.

15. The method of claim 8 wherein hydrocracking the stream rich in lighter hydrocarbons to form lighter hydrocracking products comprises hydrocracking over 50 wt % of the stream rich in lighter hydrocarbons before feeding the stream rich in heavier hydrocarbons into the lighter hydrocracking products.

16. The method of claim 8 wherein hydrocracking the stream rich in lighter hydrocarbons to form lighter hydrocracking products comprises hydrocracking over 60 wt % of the stream rich in lighter hydrocarbons before feeding the stream rich in heavier hydrocarbons into the lighter hydrocracking products.

17. The method of claim 8 wherein hydrocracking the stream rich in lighter hydrocarbons to form lighter hydrocracking products comprises hydrocracking over 70 wt % of the stream rich in lighter hydrocarbons before feeding the stream rich in heavier hydrocarbons into the lighter hydrocracking products.

18. The method of claim 8 further comprising recovering the lighter hydrocracking products and the heavier hydrocracking products as a hydrocracking effluent.

19. The method of claim 18 wherein recovering the lighter hydrocracking products and the heavier hydrocracking products as the hydrocracking effluent comprises recovering the hydrocracking effluent comprising at least about 80wt % of hydrocarbons having boiling points of less than about 382° C. (720° F.).

* * * * *